US007918949B2

(12) United States Patent
Kubo et al.

(10) Patent No.: US 7,918,949 B2
(45) Date of Patent: Apr. 5, 2011

(54) GAS GENERATING COMPOSITION

(75) Inventors: Dairi Kubo, Himeji (JP); Eishi Sato, Himeji (JP); Kenjiro Ikeda, Himeji (JP)

(73) Assignee: Nippon Kayaku Kabushiki Kaisha, Tokyo (JP)

( * ) Notice: Subject to any disclaimer, the term of this patent is extended or adjusted under 35 U.S.C. 154(b) by 683 days.

(21) Appl. No.: 11/729,723

(22) Filed: Mar. 29, 2007

(65) Prior Publication Data

US 2007/0187011 A1 Aug. 16, 2007

Related U.S. Application Data

(62) Division of application No. 10/474,760, filed on Jan. 2, 2004, now abandoned.

(51) Int. Cl.
*C06B 31/28* (2006.01)

(52) U.S. Cl. ..... 149/47; 149/45; 149/43; 149/39; 149/46

(58) Field of Classification Search ..... 149/47, 149/45, 43, 39, 46
See application file for complete search history.

(56) References Cited

U.S. PATENT DOCUMENTS

| | | | | |
|---|---|---|---|---|
| 4,948,439 | A | 8/1990 | Poole et al. | 149/46 |
| 5,071,630 | A | 12/1991 | Oberth | 423/266 |
| 5,386,775 | A | 2/1995 | Poole et al. | 102/289 |
| 5,472,647 | A * | 12/1995 | Blau et al. | 264/3.1 |
| 5,531,941 | A | 7/1996 | Poole | 264/3.4 |
| 5,545,272 | A | 8/1996 | Poole et al. | 149/48 |
| 5,592,812 | A | 1/1997 | Hinshaw et al. | 60/205 |
| 5,641,938 | A | 6/1997 | Holland et al. | 149/48 |
| 5,673,935 | A | 10/1997 | Hinshaw et al. | 280/741 |
| 5,725,699 | A | 3/1998 | Hinshaw et al. | 149/19.1 |
| 5,783,773 | A | 7/1998 | Poole | 149/36 |
| 5,872,329 | A | 2/1999 | Burns et al. | 149/36 |
| 6,039,820 | A | 3/2000 | Hinshaw et al. | 149/45 |
| 6,083,331 | A * | 7/2000 | Taylor et al. | 149/109.6 |
| 6,096,147 | A * | 8/2000 | Taylor et al. | 149/3 |
| 6,103,030 | A | 8/2000 | Taylor | 149/46 |
| 6,132,538 | A | 10/2000 | Mendenhall et al. | 149/46 |
| 6,143,102 | A | 11/2000 | Mendenhall et al. | 149/45 |
| 6,210,505 | B1 | 4/2001 | Khandhadia et al. | 149/36 |
| 6,224,697 | B1 | 5/2001 | Mendenhall et al. | 149/109.6 |
| 6,306,232 | B1 | 10/2001 | Khandhadia et al. | 149/22 |
| 6,436,211 | B1 * | 8/2002 | Mendenhall et al. | 149/109.6 |
| 6,887,326 | B2 | 5/2005 | Williams et al. | 149/109.6 |

FOREIGN PATENT DOCUMENTS

| | | |
|---|---|---|
| EP | 0 405 272 | 1/1991 |
| EP | 1 205 457 | 5/2002 |
| GB | 544675 | 4/1942 |
| JP | 10-265290 | 10/1998 |
| WO | 95/04710 | 2/1995 |
| WO | 98/06486 | 2/1998 |
| WO | 98/42642 | 10/1998 |
| WO | 00/18704 | 4/2000 |
| WO | 00/39054 | 7/2000 |
| WO | 01/00544 | 1/2001 |
| WO | 01/47811 | 7/2001 |

OTHER PUBLICATIONS

South Korean communication dated Nov. 22, 2007, with English translation.
International Search Report dated Jun. 25, 2002.
European communication dated Oct. 6, 2008.

* cited by examiner

*Primary Examiner* — C. Melissa Koslow
(74) *Attorney, Agent, or Firm* — Nields, Lemack & Frame, LLC

(57) ABSTRACT

Disclosed is a heat-treated oxidizing agent for gas generating compositions which is obtained by mixing ammonium nitrate with an inorganic compound having as an element one or two or more metal atoms selected from the group consisting of Cu, Fe, Ni, Zn, Co, Mn and Ti and subjecting the mixture to heat treatment, and a gas generating composition containing the same. This invention provides a gas generating composition comprising ammonium nitrate, which can be safely produced, does not change in density with phase transition, and has sufficient combustibility.

3 Claims, No Drawings

GAS GENERATING COMPOSITION

This application is a divisional of U.S. Ser. No. 10/474,760 filed on Jan. 2, 2004, now abandoned, the disclosure of which is incorporated herein by reference.

TECHNICAL FIELD

The present invention relates to an oxidizing agent for gas generating compositions useful for vehicle passenger-restraining devices such as air bags in automobiles or pretensioners and a gas generating composition using the same.

BACKGROUND ART

As a gas generating composition for air bags, a non-azide-based gas generating composition comprising a nitrogen-containing organic compound fuel compound serving as a fuel component in combination with an inorganic oxidizing agent, in place of a metal azide compound used so far, has been proposed in recent years. As the non-azide-based gas generating composition, there is a need for a composition generating a large number of moles of gas generated per unit weight to achieve a smaller and lighter gas generator.

Further, the gas generating composition should be safe at the time of production. If the gas generating composition is ignited at the time of production, a large amount of a high-temperature and high-pressure gas is generated, and thus there will be significant physical and human damage. Accordingly, the production process should not involve a step in which the gas generating composition or starting materials can be ignited or exploded.

In recent years, a gas generating composition using ammonium nitrate as an oxidizing agent has been proposed. Ammonium nitrate is ideal as a starting material of a gas generating composition because it generates a large amount of gas and is inexpensive. However, ammonium nitrate is unsatisfactory because it causes a change in density with phase transition in the temperature range where performance required for the gas generating composition is guaranteed. Further, the gas generating composition using ammonium nitrate as an oxidizing agent suffers from a problem that the burning rate is lower than that usually required for the gas generating composition.

To solve these problems, it has been attempted to use ammonium nitrate having a phase stabilized with a potassium salt added to ammonium nitrate. For example, desired ammonium nitrate can be obtained by dissolving ammonium nitrate and a potassium salt in an aqueous solution and then precipitating them.

Further, in an attempt to use ammonium nitrate in a gas generating composition by suppressing the phase transition thereof, WO2000/18704 (and EP0405272, DE3642850, U.S. Pat. No. 5,071,630, etc.) describes preparation of ammonium nitrate having a substantially stabilized phase by forming a complex of ammonium nitrate and a transition metal compound as shown in the following reaction:

$$2NH_4NO_3+Cu(OH)_2 \rightarrow [Cu(NH_3)_2]^{2+}.(NO_3^-)_2+2H_2O$$

However, the ammonium nitrate having a stabilized phase does still not solve problems such as a low burning rate. By forming an eutectic mixture of the phase-stabilized ammonium nitrate and a fuel component, the ammonium nitrate may be molten at a lower temperature than the melting point of ammonium nitrate and the melting point of the fuel component (hereinafter, referred to as eutectic phenomenon), and for example, a gas generating composition comprising ammonium nitrate having a phase stabilized with potassium nitrate in combination with 5-aminotetrazole excellent in characteristics as a fuel component in the gas generating composition is molten at 108° C., and cannot be used virtually in a gas generator for an air bag in automobiles.

Further, U.S. Pat. No. 6,224,697, 6,143,102, 6,132,538, 6,103,030, 6,039,820, 5,592,812, 5,673,935, and U.S. Pat. No. 5,725,699 describe a gas generating composition using a metal ammine complex approximately corresponding to ammonium nitrate having a phase stabilized by formation of a complex as described above. In particular, U.S. Pat. No. 6,103,030 describes a gas generating composition using a transition metal complex such as diammine copper (II) nitrate and a fuel component such as ammonium nitrate and guanidine nitrate. In these publications, however, it is assumed that a fuel such as guanidine nitrate used conventionally in combination with phase-stabilized ammonium nitrate is used or the fuel component is used as an aid, and it cannot be said that the fuel component can be arbitrarily selected in designing the optimum gas generating composition.

The object of the present invention is to provide an oxidizing agent for gas generating compositions containing ammonium nitrate, which can be safely produced, does not change in density with phase transition, and does not limit usable nitrogen-containing organic compounds serving as fuel components, as well as a gas generating composition with sufficient combustibility using the same.

The present inventors made extensive study to solve the problem described above, and as a result, they found that an oxidizing agent (hereinafter, referred to as heat-treated oxidizing agent) obtained by mixing ammonium nitrate with an inorganic compound having as an element at least one metal atom selected from the group consisting of Cu, Fe, Ni, Zn, Co, Mn and Ti and subjecting the mixture to heat treatment is extremely preferable as an oxidizing agent for gas generating compositions, to complete the present invention.

DISCLOSURE OF THE INVENTION

That is, the present invention relates to:

(1) A heat-treated oxidizing agent for gas generating compositions which is obtained by mixing ammonium nitrate with an inorganic compound having as an element at least one metal atom selected from the group consisting of Cu, Fe, Ni, Zn, Co, Mn and Ti and subjecting the mixture to heat treatment, and a gas generating composition using the heat-treated oxidizing agent.

(2) The heat-treated oxidizing agent as defined in the above-mentioned (1), characterized in that the heat treatment is carried out at a temperature of not higher than the melting point of ammonium nitrate.

(3) The heat-treated oxidizing agent as defined in the above-mentioned (1) or (2), characterized in that the heat treatment is carried out at temperatures of 120° C. to 160° C. for 5 hours or more.

(4) The heat-treated oxidizing agent as defined in any one of the above-mentioned (1) to (3), characterized in that 50% average particle diameter of ammonium nitrate and the inorganic compound is 100 μm or less.

(5) The heat-treated oxidizing agent as defined in any one of the above-mentioned (1) to (4), wherein the inorganic compound is at least one member selected from the group consisting of carbonates, nitrates, hydroxides, basic carbonates and basic nitrates.

(6) The heat-treated oxidizing agent as defined in any one of the above-mentioned (1) to (5), characterized in that the inorganic compound is basic copper nitrate.

(7) The heat-treated oxidizing agent as defined in any one of the above-mentioned (1) to (6), wherein the mixing ratio of ammonium nitrate to the inorganic compound is as follows:

| | |
|---|---|
| (a) ammonium nitrate | 30 to 95% by weight; and |
| (b) inorganic compound | 5 to 70% by weight. |

(8) The heat-treated oxidizing agent as defined in any one of the above-mentioned (1) to (6), wherein the inorganic compound is basic copper nitrate, and the mixing ratio of ammonium nitrate to basic copper nitrate is as follows:

| | |
|---|---|
| (a) ammonium nitrate | 40 to 95% by weight; and |
| (b) basic copper nitrate | 5 to 60% by weight. |

(9) The heat-treated oxidizing agent as defined in any one of the above-mentioned (1) to (6), characterized in that 50% or less of the stoichiometric amount of the inorganic compound in forming a complex with ammonium nitrate is used.

(10) A gas generating composition comprising a nitrogen-containing organic compound fuel and an oxidizing agent, characterized in that a part or the whole of the oxidizing agent is the heat-treated oxidizing agent as defined in any one of the above-mentioned (1) to (9).

(11) The gas generating composition as defined in the above-mentioned (10), characterized in that when combined with ammonium nitrate, the nitrogen-containing organic compound fuel is molten at a lower temperature than the melting point of ammonium nitrate and the melting point of the fuel.

(12) The gas generating composition as defined in the above-mentioned (10) or (11), characterized in that the nitrogen-containing organic compound fuel is one or two or more members selected from the group consisting of tetrazoles and guanidine derivatives.

(13) The gas generating composition as defined in the above-mentioned (10) or (11), wherein the nitrogen-containing organic compound fuel is one or two or more members selected from the group consisting of 5-aminotetrazole, metal aminotetrazolate, bitetrazole, metal bitetrazolate, ammonium bitetrazolate, nitroguanidine, guanidine nitrate, triaminoguanidine and dicyandiamide.

(14) The gas generating composition as defined in the above-mentioned (10) or (11), characterized in that the nitrogen-containing organic compound fuel comprises 5-aminotetrazole.

(15) A gas generating composition characterized by comprising at least the following components:

(a) 5-aminotetrazole;

(b) ammonium nitrate; and (c) basic copper nitrate, wherein the above-mentioned (b) and (c) are heat-treated.

(16) A gas generating composition characterized by comprising at least the following components:

(a) 5-aminotetrazole;

(b) ammonium nitrate; and (c) basic copper nitrate, wherein the above-mentioned (b) and (c) are heat-treated and further secondarily heat-treated together with (a) and water.

(17) A gas generating composition characterized by comprising at least the following components on a weight basis:

| | |
|---|---|
| (a) 5-aminotetrazole | 10 to 40% by weight; |
| (b) ammonium nitrate | 30 to 70% by weight; and |
| (c) basic copper nitrate | 5 to 40% by weight, |

wherein the above-mentioned (b) and (c) are heat-treated.

(18) A gas generating composition characterized by comprising at least the following components on a weight basis:

| | |
|---|---|
| (a) 5-aminotetrazole | 10 to 40% by weight; |
| (b) ammonium nitrate | 30 to 70% by weight; and |
| (c) basic copper nitrate | 5 to 40% by weight, |

wherein the above-mentioned (b) and (c) are heat-treated and further secondarily heat-treated together with water in an amount of 1 to 20% by weight relative to the total amount of the components (a), (b) and (c).

(19) The gas generating composition as defined in the above-mentioned (16) or (18) characterized in that the secondary heat treatment is carried out at temperatures of 90° C. to 120° C. for 10 hours or more.

(20) A gas generating composition characterized by comprising at least the following components:

(a) tetrazoles;

(b) ammonium nitrate; and (c) an inorganic compound comprising Cu as an element, wherein the above-mentioned (a), (b) and (c) are mixed, water is added thereto, and the mixture is heat-treated.

(21) A gas generating composition characterized by comprising at least the following components:

(a) 5-aminotetrazole;

(b) ammonium nitrate; and (c) basic copper nitrate, wherein the above-mentioned (a), (b) and (c) are mixed, water is added thereto, and the mixture is heat-treated.

(22) A gas generating composition characterized by comprising at least the following components on a weight basis:

| | |
|---|---|
| (a) 5-aminotetrazole | 10 to 40% by weight; |
| (b) ammonium nitrate | 30 to 70% by weight; and |
| (c) basic copper nitrate | 5 to 40% by weight, |

wherein the above-mentioned (a), (b) and (c) are mixed, water is added thereto, and the mixture is heat-treated.

(23) A gas generating composition characterized by comprising at least the following components on a weight basis:

| | |
|---|---|
| (a) 5-aminotetrazole | 10 to 40% by weight; |
| (b) ammonium nitrate | 30 to 70% by weight; and |
| (c) basic copper nitrate | 5 to 40% by weight, |

wherein the above-mentioned (a), (b) and (c) are mixed, water is added in an amount of 1 to 20% by weight relative to the total amount of the components (a), (b) and (c), and the mixture is heat-treated.

(24) The gas generating composition as defined in any one of the above-mentioned (20) to (23), characterized in that the heat treatment is carried out at temperatures of 120° C. to 160° C. for 5 hours or more.

(25) The gas generating composition as defined in any one of the above-mentioned (10) to (24), characterized by further comprising one or two or more members selected from the group consisting of silicon nitride, silicon carbide, silicon dioxide, talc, clay, alumina, molybdenum trioxide and synthetic hydrotalcite.

(26) The gas generating composition as defined in any one of the above-mentioned (10) to (25), characterized by further comprising one or two or more members selected from the group consisting of a silane compound, guar gum, polyvinyl alcohol, carboxymethyl cellulose, polyvinyl pyrrolidone and methyl cellulose.

(27) A gas generator for a vehicle passenger-restraining device using the gas generating composition as defined in the above-mentioned (10) to (26) or a gas generating composition comprising the heat-treated oxidizing agent as defined in the above-mentioned (1) to (9).

BEST MODE FOR CARRYING OUT THE INVENTION

The heat-treated oxidizing agent of the present invention is obtained by mixing ammonium nitrate with an inorganic compound having as an element one or two or more metal atoms selected from the group consisting of Cu, Fe, Ni, Zn, Co, Mn and Ti and subjecting the mixture to heat treatment, and the gas generating composition of the present invention comprises the heat-treated oxidizing agent. The heat-treated oxidizing agent obtained by heat treatment does not cause the phase transition of ammonium nitrate, and achieves higher combustibility when used in a gas generating composition than by ammonium nitrate only.

The inorganic compound used in combination with ammonium nitrate to form the heat-treated oxidizing agent is not particularly limited insofar as it is an inorganic compound having as an element one or two or more metal atoms selected from the group consisting of Cu, Fe, Ni, Zn, Co, Mn and Ti, all of which can be stably present, and the inorganic compound may be an inorganic compound containing a plurality of metal atoms as elements, and such inorganic compounds may be used alone or as a mixture of two or more thereof.

Specifically, the inorganic compound is preferably one or two or more members selected from the group consisting of Cu, Fe, Ni, Zn, Co, Mn or Ti carbonates, nitrates, sulfates, hydroxides, oxides and basic carbonates and basic nitrates, more preferably one or two or more members selected from the group consisting of Cu, Co or Fe carbonates, nitrates, sulfates, hydroxides, oxides and basic carbonates and basic nitrates, still more preferably one or two or more members selected from the group consisting of Cu carbonates, nitrates, sulfates, hydroxides, oxides and basic carbonates and basic nitrates. The inorganic compound is also preferably one or more members selected from the group consisting of Cu, Fe, Ni, Zn, Co, Mn or Ti nitrates, basic carbonates and basic nitrates, more preferably one or two or more members selected from the group consisting of Cu, Fe, Ni, Zn, Co, Mn or Ti basic nitrates, particularly preferably one or more members selected from the group consisting of Cu, Co and Fe basic nitrates. The inorganic compound is preferably basic copper nitrate. The heat-treated oxidizing agent can be obtained usually in a mixing ratio of 5 to 70% by weight of the inorganic compound relative to 30 to 95% by weight of ammonium nitrate. When basic copper nitrate is used, a mixing ratio of 5 to 60% by weight of basic copper nitrate relative to 40 to 95% by weight of ammonium nitrate is preferable.

The oxidizing power exhibited by the heat-treated oxidizing agent of the present invention is attributable to oxygen atoms contained as elements, and supplies oxygen in $H_2O$ and $CO_2$ formed by combustion of the gas generating composition, and the oxidizing agent in the gas generating composition preferably generates a higher amount of oxygen per unit weight in order to reduce the amount thereof used in the fuel component. The heat-treated oxidizing agent also generates $N_2$ and $H_2O$ upon combustion, thus contributing to the total amount of the gas generated from the gas generating composition, and it can be said that an oxidizing agent generating a higher amount of $N_2$ and $H_2O$ per unit weight is preferable for the gas generating composition. The heat-treated oxidizing agent of the present invention employs the inorganic compound, and metal atoms constituting the inorganic compound do not contribute to the amount of the gas generated, and undesirably causes generation of slug, and thus the amount of metal atoms contained per unit weight is preferably lower.

From the above viewpoint, the mixing ratio of ammonium nitrate to the inorganic compound in the heat-treated oxidizing agent of the present invention is determined preferably such that the amount of the inorganic compound is reduced to the minimum level. For example, the mixing ratio may be determined on the basis of the stoichiometric amount for forming a complex such as $[Cu(NH_3)_2]^{2+}.(NO_3^-)_2$, but the effect of phase stabilization of ammonium nitrate in the heat-treated oxidizing agent of the present invention is not attributable to only formation of the complex, and thus the mixing ratio may be not higher than the stoichiometric amount, and the inorganic compound is used in an amount of preferably not higher than 50% by weight of the stoichiometric amount for formation of the complex, more preferably not higher than 30% by weight in order to prepare the heat-treated oxidizing agent. However, when the amount of the inorganic compound is too low, the effect of phase stabilization may not be substantially recognized, and thus the inorganic compound is used preferably in an amount of not less than 5% by weight in the heat-treated oxidizing agent.

Now, the heat treatment for converting a mixture of ammonium nitrate and the inorganic compound into a heat-treated oxidizing agent is described in more detail.

Heat treatment is carried out usually in the temperature range of not higher than the melting point of ammonium nitrate. Specifically, heat treatment is carried out preferably at temperatures of 120° C. to 160° C. The time necessary for heat treatment is reduced in proportion to the temperature of heat treatment, but a temperature of 120° C. or less is not preferable because much time is required until heat treatment is finished. A temperature of higher than 160° C. is not preferable either because ammonium nitrate is molten. When ammonium nitrate is molten, it is solidified as a lump upon cooling, thus making subsequent steps such as pulverization difficult and requiring a special step for solidification in a powdery form. In the heat-treated oxidizing agent in the present invention, a combination of ammonium nitrate and basic copper nitrate, for example, initiates exothermic decomposition at about 220° C., and thus heat treatment at high temperatures can easily cause ignition and rapid decomposition. In the heat-treatment temperature range in the present invention, ammonium nitrate is not molten, and thus the heat-treated oxidizing agent is not solidified as a lump, thus facilitating the later step of pulverization, and can be produced highly safely.

Further, heat treatment may be carried out until the weight is reduced by 10 to 30%, and is not reduced anymore after the heat treatment is initiated, and the time of heat treatment is usually 5 to 48 hours depending on the heat-treatment temperature, the inorganic compound used, and the mixing ratio.

In the heating treatment, ammonium nitrate and the inorganic compound may be mixed in a V-shaped mixer, a ball mill etc. and then heat-treated as it is in a heating oven, but preferably the mixture is heat-treated under stirring. When a heating oven equipped with a stirring blade is used, the mixture can be mixed and simultaneously heat-treated. The heat-treatment time can be reduced under stirring.

50% average particle diameter of ammonium nitrate and the inorganic compound used in heat treatment is preferably 200 μm or less, more preferably 100 μm or less. When this diameter exceeds 200 μm, much time may be necessary until heat treatment is finished.

In the stage of mixing and/or heat treatment of ammonium nitrate and the inorganic compound, additives such as water may be used if necessary.

The heat-treated oxidizing agent may be mixed directly as an oxidizing with a fuel to form a gas generating composition, but is preferably pulverized again to regulate 50% average particle diameter before use.

The heat-treated oxidizing agent thus obtained can be mixed with a nitrogen-containing organic compound fuel to form a gas generating composition. Not only the heat-treated oxidizing agent but also oxidizing agents allowable in the field of gas generating compositions can be used, and examples of such oxidizing agents include metal nitrates such as strontium nitrate. If necessary, various additives can also be used.

Now, the nitrogen-containing organic compound fuel used in the present invention is described. The nitrogen-containing organic compound fuel used as a fuel component in the present invention may be those used widely in this field, but is preferably one or two or more members selected from the group consisting of guanidine derivatives, tetrazoles, bitetrazole derivatives, triazole derivatives, hydrazine derivatives, triazine derivatives, azodicarbonamide derivatives, dicyanamide derivatives and nitrogen-containing transition metal complexes, more preferably one or two or more members selected from the group consisting of tetrazoles and guanidine derivatives. Examples thereof include nitroguanidine, guanidine nitrate, 5-aminotetrazole, metal aminotetrazolate, metal bitetrazolate, monoammonium bitetrazolate, diammonium bitetrazolate, 5-oxo-1,2,4-triazole, cyanoguanidine, triaminoguanidine, triaminoguanidine nitrate, trihydrazinotriazine, burette, azodicarbonamide, biurea, carbohydrazide, carbohydrazide transition metal complex nitrate, dihydrazide oxalate, hydrazine metal complex nitrate, sodium dicyanamide, triaminoguanidine, bis(dicyandiamide) copper (I) nitrate, 5-aminotetrazole copper complex, etc. The nitrogen-containing organic compound fuel is preferably one or two or more member selected from the group consisting of 5-aminotetrazole, metal aminotetrazolate, bitetrazole, metal bitetrazolate, ammonium bitetrazolate, nitroguanidine, guanidine nitrate, triaminoguanidine and dicyandiamide.

Particularly in the gas generating composition of the present invention, the eutectic phenomenon is caused depending on the combination with ammonium nitrate as described above, and even a combination with a nitrogen-containing organic compound fuel (hereinafter, referred to as eutectic fuel) to be molten at a low temperature does not undergo the eutectic phenomenon at least at the practical level, and use of the eutectic fuel as the nitrogen-containing organic compound fuel leads to the maximum utilization of the effect of the heat-treated oxidizing agent of the present invention.

The eutectic fuel includes tetrazole derivatives although the eutectic degree is varied, and specifically 5-aminotetrazole can be mentioned because of its general use in gas generating compositions.

The eutectic fuels can be used alone or as a mixture of two or more thereof. Further, in a mixed nitrogen-containing organic compound fuel wherein a nitrogen-containing organic compound fuel substantially not causing the eutectic phenomenon is combined with an eutectic fuel (hereinafter, referred to as non-eutectic/eutectic mixed fuel), the composition ratio to cause the eutectic phenomenon with ammonium nitrate, that is, the ratio by weight of the eutectic fuel in the non-eutectic/eutectic mixed fuel, is typically 10% or more, more typically 50% or more, still more typically 75% or more at which the effect of the heat-treated oxidizing agent of the present invention can be utilized to the maximum degree, as also achieved by using only the eutectic fuel.

When an eutectic fuel, particularly 5-aminotetrazole is used in the present invention, it is mixed with the heat-treated oxidizing agent, then supplied with water, granulated and heat-treated (this heat treatment is referred to hereinafter as secondary heat treatment in order to be distinguishable from the heat treatment of the heat-treated oxidizing agent), whereby a gas generating composition capable of burning at a higher rate and excellent in heat resistance can be obtained. The secondary heat treatment may be carried out until the weight of water added is reduced and the weight of the granules is further reduced by 10 to 40% and is not reduced anymore, and the time of heat treatment is usually 10 to 48 hours depending on the heat-treatment temperature, the inorganic compound used, and the composition ratio. Keeping the composition at high temperature for a long time in the secondary heat treatment is not preferable for safety because the composition is made of explosives. The secondary heat treatment is highly safe because of its lower temperature than in producing the heat-treated oxidizing agent by heat treatment.

As described above, a gas generating composition comprising 5-aminotetrazole and ammonium nitrate is molten usually at temperatures of about 100° C. The gas generating composition of the present invention is not molten even at a temperature of 120° C. This is because the heat-treated oxidizing agent of the present invention hardly causes the eutectic phenomenon with 5-aminotetrazole, and further secondary heat treatment is considered to improve heat resistance. Before and after the secondary heat treatment, the color of the gas generating composition changes from pale blue to green. When the average particle diameter of the nitrogen-containing organic compound is too large, the resulting molded gas generating composition is poor in strength, while when it is too small, much costs are required for pulverization, and thus 50% average particle diameter is preferably 5 to 80 μm, more preferably 10 to 50 μm.

Additives which can be used if necessary in the gas generating composition of the present invention may be various additives used usually in gas generating compositions, and for example, a slug forming agent, an auto-ignition agent, a binder, etc. can be mentioned, and these additives can be used alone or as a mixture of two or more thereof. An additive that may decompose any components in the gas generating composition is preferably not added.

The slag-forming agent which can be used in the present invention includes, for example, silicon nitride, silicon carbide, silicon dioxide, talc, clay, alumina, and the auto-ignition agent includes molybdenum trioxide etc. The content of each of the slug-forming agent and auto-ignition agent is usually 0.1 to 10% by weight, more preferably 0.5 to 5% by weight. When the content is lower that that, the effect of the additives may not be sufficiently exhibited, while when the content is too high, the amount of the gas generated from the gas generating agent may be reduced.

The binder includes, for example, synthetic hydrotalcite, guar gum, polyvinyl alcohol, carboxymethyl cellulose, polyvinyl pyrrolidone, methyl cellulose etc. The content of the binder is preferably 0.5 to 10% by weight, more preferably 1 to 8% by weight. When the content is lower than that, the effect of the binder may not be sufficiently exhibited, while when the content is too high, the amount of the gas generated from the gas generating agent may be reduced. A silane compound can also be mentioned as a preferable additive in the present invention.

The composition ratio of the respective components in the gas generating composition of the present invention is preferably about the stoichiometric amount (oxygen balance, 0) in which the components such as the nitrogen-containing organic compound fuel and the heat-treated oxidizing agent are completely combustible, but depending on the burning conditions of a gas generator, the oxygen balance may be changed. The gas generating composition of the present invention may be, for example, in the form of powder, granules, spherical tablets, a cylinder, a single-perforated cylinder, and a multi-perforated cylinder or tablets, but the shape is not particularly limited.

Now, preferable combinations in the present invention are illustrated.

In the gas generating composition of the present invention, it is preferable that basic copper mitrate is used as the inorganic compound used in the heat-treated oxidizing agent, and 5-aminotetrazole is used as the nitrogen-containing organic compound fuel. Specifically, the heat-treated oxidizing agent obtained by mixing ammonium nitrate with basic copper nitrate and heat-treating the mixture is mixed with 5-aminotetrazole and other additives added if necessary, to give a gas generating composition, and when the heat-treated oxidizing agent is mixed with 5-aminotetrazole and the additives, it is preferable to add water and to conduct heat treatment (secondary heat treatment). Further, this water is used preferably in an amount of 1 to 20% by weight relative to the total amount of the heat-treated oxidizing agent, 5-aminotetrazole and other additives added if necessary.

The respective components are used preferably such that 5-aminotetrazole is 10 to 40% by weight, ammonium nitrate is 30 to 70% by weight, and basic copper nitrate is 5 to 40% by weight (expressed on a weight basis in the gas generating composition). This composition ratio is indicative of the amounts of the respective components used, but does not indicate that the respective components are contained in the defined amounts in the resulting gas generating composition.

The amount of additives added as necessary is determined according to the properties of the additives used, and may be used in such a range as not to deteriorate the performance of the gas generating composition, and for example, when silicon dioxide is added as an additive, its content is preferably 0.5 to 5% by weight in the gas generating composition.

Now, another embodiment of the gas generating composition of the present invention is described. The gas generating agent of the present invention can also be obtained by mixing tetrazoles as a fuel, ammonium nitrate as an oxidizing agent and an inorganic compound containing Cu as an element, then adding water thereto and heat-treating the mixture. This heat treatment can be carried out to achieve the effects of both the heat treatment in forming the heat-treated oxidizing agent and the secondary heat treatment simultaneously, that is, the effect on phase stabilization of ammonium nitrate and the effect for preventing the eutectic phenomenon of the eutectic fuel with ammonium nitrate.

The fuel used is particularly preferably 5-aminotetrazole. The inorganic compound containing Cu as an element includes basic copper carbonate, copper nitrate, copper sulfate, copper hydroxide, copper oxide and basic copper nitrate, particularly preferably basic copper nitrate.

The amount of water added is not particularly limited, but is preferably 1 to 20% by weight, and the mixture may be prepared in a slurry form and then granulated. In this range, the mixture is in the form of wet grains and can be easily granulated after heat treatment.

The heat treatment is carried out usually at a temperature of not higher than the melting point of ammonium nitrate. Specifically, the heat treatment is carried out preferably at temperatures of 120° C. to 160° C. The time necessary for the heat treatment is reduced in proportion to the temperature of the heat treatment, but a temperature of 120° C. or less is not preferable because much time is required until heat treatment is finished. A temperature of the melting point of higher than 160° C. is not preferable either because ammonium nitrate is molten.

Now, the method of producing the gas generating composition of the present invention is described. The respective components such as the nitrogen-containing organic compound and the heat-treated oxidizing agent are mixed in a V-shaped mixer or a ball mill. Powder obtained by mixing the components may be directly molded or tabletted into a molded gas generating agent. Alternatively, the components are mixed and simultaneously sprayed with a suitable amount of water, an organic solvent etc. to give a wet lump which is then granulated and dried under heating at about 100° C., whereby firm granules can be obtained. Thereafter, the granules are tabletted to give a molded gas generating agent. Alternatively, the wet lump may be directly extruded and extrusion-molded with an extrusion molding machine. In either case, a firm molded gas generating agent can be obtained by molding a gas generating agent and then drying it under heating at about 100° C.

In the production method described above, the secondary heat treatment is carried out during heating drying for preparation of granules and/or heating drying after molding. When heat treatment such as heating drying is carried out while the respective components for the gas generating composition are mixed to give the gas generating composition, the above heat drying may also serve as secondary heat treatment, but additional heat treatment may be conducted as secondary heat treatment.

Now, heat treatment of the mixture of a fuel and an oxidizing agent all at once to omit heat treatment of the heat-treated oxidizing agent is described. The respective components such as tetrazoles, ammonium nitrate and the inorganic compound containing Cu as an element are mixed in a V-shaped mixer or a ball mill. These components are mixed and simultaneously sprayed with a suitable amount of water, an organic solvent etc. to give a wet lump which is then granulated and dried under heating at about 120 to 160° C., whereby firm granules can be obtained. Thereafter, the granules are tabletted to give a molded gas generating agent. Alternatively, the wet lump may be directly extruded and extrusion-molded with an extrusion molding machine.

A gas generator for vehicle passenger-restraining devices such as air bags or pretensioners, which comprises the gas generating composition of the present invention, shows preferable performance for gas generation.

EXAMPLES

Hereinafter, the present invention is described in more detail by reference to the Examples.

Example 1

55.5 parts by weight of ammonium nitrate (50% average particle diameter, 13 μm) and 18.5 parts by weight of basic copper nitrate (50% average particle diameter, 5 μm) as an inorganic compound were weighed and mixed in a V-shaped mixer. The resulting mixture was heat-treated in a heating oven at 150° C. for 24 hours. The resulting heat-treated oxidizing agent was pulverized in a pin mil pulverizer until the 50% average particle diameter was reduced to 12 μm. 24.0 parts by weight of 5-aminotetrazole (50% average particle diameter, 15 μm) as a nitrogen-containing organic compound fuel and 2.0 parts by weight of silicon dioxide (50% average particle diameter, 3 μm) as a slug-forming agent were added thereto and mixed in the V-shaped mixer. Then, the mixture was mixed and simultaneously sprayed with water in an amount of 8% by weight relative to the whole of the mixture, and then granulated in a wet system to form granules having an average particle diameter of 1 mm or less. The granules were subjected to heat treatment (secondary heat treatment) at 105° C. for 15 hours, press-molded with a rotating tabletting machine and then dried by heating at 110° C. for 15 hours to give tablets of the gas generating composition of the present invention having a diameter of 5 mm and a height of 1.5 mm.

The tablets were subjected to a heat-resisting test at 120° C. for 100 hours and a heat shock test consisting of 200 cycles of cooling at −40° C. and heating at 107° C., and the hardness of the tablets was measured with a Monsanto hardness meter. The results are shown in Table 1.

Example 2

55.5 parts by weight of ammonium nitrate (50% average particle diameter, 13 μm) and 18.5 parts by weight of basic copper nitrate (50% average particle diameter, 5 μm) as an inorganic compound were weighed and mixed in a V-shaped mixer. The resulting mixture was heat-treated in a heating oven at 150° C. for 24 hours to give a heat-treated oxidizing agent in a powdery form. The powder was analyzed at temperatures of up to 500° C. by a DTA-TG differential thermal analyzer. The results are shown in Table 2.

Example 3

24.0 parts by weight of 5-aminotetrazole (50% average particle diameter, 15 μm) as a nitrogen-containing organic compound, 55.5 parts by weight of ammonium nitrate (50% average particle diameter, 13 μm), 18.5 parts by weight of basic copper nitrate (50% average particle diameter, 5 μm), and 2.0 parts by weight of silicon dioxide (50% average particle diameter, 3 μm) as a slug-forming agent were mixed in a V-shaped mixer. Then, the mixture was mixed and simultaneously sprayed with water in an amount of 10% by weight relative to the whole of the mixed powder, and then granulated in a wet system to form granules having an average particle diameter of 1 mm or less. The granules were heat-treated at 150° C. for 24 hours, press-molded with a rotating tabletting machine and then dried by heating at 110° C. for 15 hours to give a gas generating composition in a tablet form having a diameter of 5 mm and a height of 1.5 mm.

The tablets were subjected to a heat-resisting test at 120° C. for 100 hours and a heat shock test consisting of 200 cycles of cooling at −40° C. and heating at 107° C., and the hardness of the tablets were measured with a Monsanto hardness meter. The results are shown in Table 1.

Comparative Example 1

26.5 parts by weight of 5-aminotetrazole (50% average particle diameter, 15 μm) as a nitrogen-containing organic compound, 72.5 parts by weight of ammonium nitrate (50% average particle diameter, 13 μm) having a phase stabilized with potassium nitrate, and 2.0 parts by weight of silicon dioxide (50% average particle diameter, 3 μm) as a slug-forming agent were mixed in a V-shaped mixer. Then, the mixture was mixed and simultaneously sprayed with water in an amount of 8% by weight relative to the whole of the mixed powder, and then granulated in a wet system to form granules having an average particle diameter of 1 mm or less. The granules were heat-treated at 100° C. for 15 hours, press-molded with a rotating tabletting machine and then dried by heating at 100° C. for 15 hours to give a gas generating composition in a tablet form having a diameter of 5 mm and a height of 1.5 mm.

The tablets were subjected to a heat-resisting test at 120° C. for 100 hours and a heat shock test consisting of 200 cycles of cooling at −40° C. and heating at 107° C., and the hardness of the tablets were measured with a Monsanto hardness meter. The results are shown in Table 1.

Comparative Example 2

55.5 parts by weight of ammonium nitrate (50% average particle diameter, 13 μm) and 18.5 parts by weight of basic copper nitrate (50% average particle diameter, 5 μm) as an inorganic compound were weighed and mixed in a V-shaped mixer to give a heat-treated oxidizing agent in a powdery form. The powder was analyzed at temperatures of up to 500° C. by a DTA-TG differential thermal analyzer. The results are shown in Table 2.

TABLE 1

| | | Hardness of the tablets | |
|---|---|---|---|
| | | Result of the heat-resisting test | Result of the heat shock test |
| Example 1 | Before the test | 10.5 kgf | 10.5 kgf |
| | After the test | 10.1 kgf | 9.8 kgf |
| Example 3 | Before the test | 11.5 kgf | 11.5 kgf |
| | After the test | 10.5 kgf | 10.6 kgf |
| Comparative Example 1 | Before the test | 10.3 kgf | 10.3 kgf |
| | After the test | Molten | Powdered and partially molten |

TABLE 2

| | DTA-TG measurement result |
|---|---|
| Example 2 | No endothermic or exothermic peak was not observed at temperatures of up to about 220° C., and no change in weight was caused. |
| Comparative Example 2 | Appearance of endothermic peaks at 60° C. and 130° C., and a reduction in weight by about 6% in the temperature range of 100 to 170° C. |

In Example 1 wherein the oxidizing component was heat-treated, no deterioration in the tablets is recognized in the heat-resisting test and heat shock test, as is evident from Table 1.

Further, in Example 3 wherein the fuel component and the oxidizing component were heat-treated, no deterioration in the tablets is recognized in the heat-resisting test and heat shock test. However, in Comparative Example 1 wherein ammonium nitrate having a phase stabilized with potassium nitrate is combined with 5-aminotetrazole, the tablets are molten in the heat-resisting test, and the tablets are powdered and partially molten in the heat shock test, and are not maintained in the original shape, and the effect (by which melting is not observed) on the eutectic phenomenon of ammonium nitrate and 5-aminotetrazole evidently appears.

In Comparative Example 2 wherein heat treatment was not carried out to compare the oxidizing agent, endothermic peaks estimated to be attributable to phase change appear at about 60° C. and about 130° C., as is evident from Table 2. Further, a reduction in weight by about 6% is caused in the temperature range of 100° C. to 170° C. However, in Example 2 wherein heat treatment was carried out, an endothermic peak attributable to phase change is not observed even in the same composition. Because no reduction in weight is observed, it is estimated that heat resistance is improved without any change in volume by heat shock.

INDUSTRIAL APPLICABILITY

According to the present invention, there can be obtained an oxidizing agent component which even though ammonium nitrate is used, inhibits phase change and is compatible with a fuel component such as 5-aminotetrazole, as well as a gas generating composition using the oxidizing agent. Further, the oxidizing agent and the gas generating composition according to the present invention can be produced highly safely, and do not cause a change in volume with phase change unique to ammonium nitrate.

The invention claimed is:

1. A gas generating composition comprising at least the following components:

(a) 5-aminotetrazole;

(b) ammonium nitrate; and (c) basic copper nitrate, wherein the above-mentioned (a), (b) and (c) are mixed, water is added thereto, and the mixture is heated-treated at temperatures of 120° C. to 160° C.

2. A gas generating composition comprising at least the following components on a weight basis:

| | |
|---|---|
| (a) 5-aminotetrazole | 10 to 40% by weight; |
| (b) ammonium nitrate | 30 to 70% by weight; and |
| (c) basic copper nitrate | 5 to 40% by weight, |

wherein the above mentioned (a), (b) and (c) are mixed, water is added thereto, and the mixture is heated-treated at temperatures of 120° C. to 160° C.

3. A gas generating composition comprising at least the following components on a weight basis:

| | |
|---|---|
| (a) 5-aminotetrazole | 10 to 40% by weight; |
| (b) ammonium nitrate | 30 to 70% by weight; and |
| (c) basic copper nitrate | 5 to 40% by weight, |

wherein the above mentioned (a), (b) and (c) are mixed, water is added in an amount of 1 to 20% by weight relative to the total amount of the components (a), (b) and (c), and the mixture is heated-treated at temperatures of 120° C. to 160° C.

* * * * *